United States Patent [19]

Hind

[11] 3,941,281

[45] Mar. 2, 1976

[54] CONTROL DEVICE FOR REGULATING TEEMING RATE

[75] Inventor: Robert Duncan Hind, Sheffield, England

[73] Assignee: United States Steel Corporation, Pittsburgh, Pa.

[22] Filed: Oct. 21, 1974

[21] Appl. No.: 516,533

[30] Foreign Application Priority Data

Oct. 31, 1973 United Kingdom ..... 50541/73

[52] U.S. Cl. ..... 222/56; 164/281; 222/58; 222/63

[51] Int. Cl.[2] ..... B22D 37/00; B22D 41/10

[58] Field of Search ..... 222/1, 56, 58, 63, 504; 164/281, 155

[56] References Cited

UNITED STATES PATENTS

| | | | |
|---|---|---|---|
| 3,439,759 | 4/1969 | Rouanet et al. | 222/56 X |
| 3,457,985 | 7/1969 | Wilson | 164/281 X |
| 3,599,835 | 8/1971 | Kocks | 222/58 |

*Primary Examiner*—Drayton E. Hoffman
*Assistant Examiner*—David A. Scherbel
*Attorney, Agent, or Firm*—Walter P. Wood

[57] ABSTRACT

Teeming of molten metal from a laden vessel into a receiving vessel such as an ingot mould or tundish is accomplished at a controlled rate by detecting the changing weight of one of the vessels and deriving a valve control signal by comparing a changing weight signal with a presettable reference signal, the valve control signal being employed to adjust the setting of a sliding gate valve through which molten metal passes as it is teemed into the receiving vessel.

10 Claims, 2 Drawing Figures

CONTROL DEVICE FOR REGULATING TEEMING RATE

Figure 1:
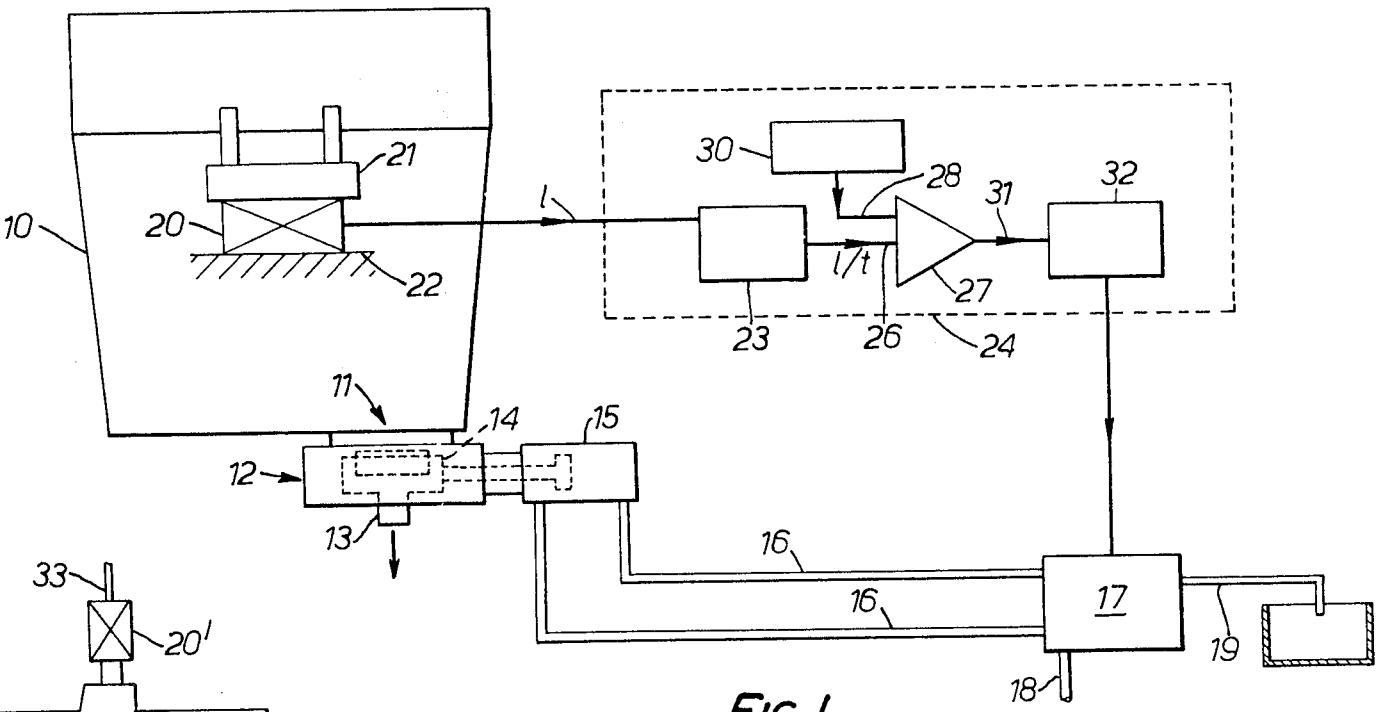

The present invention relates to improvements in the casting of molten metals, such as steel.

In many steel and foundry processes, the ability to pour or teem molten metal from a container at a controlled flow rate throughout the teeming operation would be desirable. It may, for example, be preferred that the flow rate remains constant during the greater part of the teeming operation. At the beginning and end of the operation, reduced flow rates may be desired. Unless the flow rate is suitably controlled, metallurgical properties of ingots cast successively from the same melt can vary undesirably. In a continuous casting operation, it is also desirable that the molten metal in a tundish is replenished continually whilst the casting proceeds and that the flow to the mould is constant in order to achieve a uniform withdrawal speed of the casting from the mould.

Hitherto, it has been impossible to achieve, in a simple manner, a controlled or constant flow rate from a bottom-pour vessel such as a ladle, for two principal reasons. Firstly, the pressure head at a discharge orifice continuously changes as molten metal flows out of the orifice and the level of the molten metal falls in the ladle. Secondly, flow of molten metal through an orifice can erode the orifice, causing it to enlarge. The erosion problem can, in principle, be minimised if the discharge orifice is made from suitable refractory materials now available. However, the problem arising from the change in pressure head remains.

According to one aspect of the present invention, there is provided apparatus for admitting molten metal into a receiver vessel at a controlled rate, including a charging vessel having a discharge orifice controlled by a sliding gate valve, for delivering the melt from the charging vessel to the receiver vessel, and means for actuating the sliding gate valve to control flow rate therethrough, the said means relying solely upon a monitoring of the overall weight of one of the vessels and including a load sensor therefor, the apparatus further including a control circuit, which solely compares a time-varying signal from the sensor with a presettable reference signal representing a given flow rate and generates an output signal, the output signal being applied to a valve actuator provided to control the setting of the valve. In practice, as metal is flowing out of the charging vessel, the overall weight thereof falls continuously and the overall weight of the receiver vessel rises concomitantly. By determining one of these weights, a measure of the actual flow rate through the orifice is gained. The control circuit operates to change the valve setting as needed to equalise the actual flow rate with the desired flow rate. Thus, it is possible to overcome the effect of changing pressure head upon the pouring rate.

The charging vessel can be a bottom-pour vessel such as a ladle. It could, however, be an intermediate holding vessel such as a vacuum degasser, or a tundish used in continuous casting plant, in which case flow of melt from the tundish to the continuous casting mould may be controlled by weight monitoring of the tundish.

In a conventional casting operation where a bottom-pour ladle charges a series of moulds successively, the load sensor is most conveniently used to monitor the overall weight of the ladle. The invention makes it possible to pour the castings under substantially uniform conditions. For a continuous-casting process, however, it may be preferred instead to monitor the weight of a receiving tundish. The valve of the charging vessel or ladle can then be controlled to keep the tundish weight constant and hence to maintain a constant level of melt therein.

Conveniently, but not essentially, the load sensor comprises one or more load cells, preferably of the strain-gauge type. In the embodiment to be described in detail, the control circuit first differentiates the load sensor output with respect to time. Then the resulting signal is applied to a difference amplifier receiving a presettable second input signal representing the desired flow rate. The difference amplifier then generates an error output signal to control the valve actuator. The valve actuator in the preferred example comprises a double-acting hydraulic ram controlled by an electrically operated flow-control valve, to which the said output signal is fed. The flow-control valve can be servo or solenoid operated, and preferably is of a pressure-compensated type. Alternatively, the valve actuator could be wholly electrical in nature, the actuator then employing, for example, a motor such as a servo motor, a solenoid or the like arranged to produce linear movement of the sliding gate valve in response to the error output signal.

The invention also comprehends a method of teeming molten metal into a receiver vessel at a controlled rate using apparatus embodying the invention.

The invention also provides a method of teeming molten metal at a controlled rate, wherein the molten metal is contained in a charging vessel and is discharged therefrom into a receiver vessel by opening a sliding gate valve in the charging vessel, the weight of one or the other vessel and its contents is monitored during teeming, the weight measurements are electrically compared with a presettable reference and a control signal is obtained which is employed to vary the setting of the valve thereby to control flow of molten metal from the charging vessel.

Figure 2:
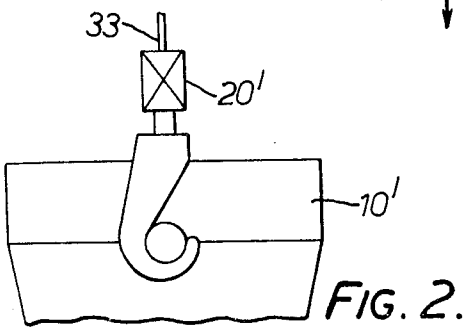

The invention will now be described by way of example with reference to the accompanying drawings, in which:

FIG. 1 is a diagrammatic illustration of steel equipment embodying the invention, and FIG. 2 illustrates a modification of the equipment shown in FIG. 1.

The steelworks equipment shown in FIG. 1 includes a container 10 for molten metal which is to be poured, for example, into one or more moulds, not shown. The container 10 is in the form of a bottom-pour ladle having a discharge orifice 11 in its bottom. The orifice 11 is opened and closed by a valve 12 of the sliding-gate type. The valve has a discharge nozzle 13 through which the molten metal passes when the gate 14 is opened. Those parts of the gate 14 which are exposed to molten metal are made from an erosion-resistant material. A satisfactory material has a high content of alumina, normally in the range of 85 to 95% by weight. This material has a high density and is high temperature fired. Zirconia could be used instead, however. Materials that will help to prevent alumina build-up when Al-killed steels are poured can also be used. When pouring some steels, it is desirable that the parts of the gate 14 exposed to the molten metal be basic. One suitable basic material is magnesite.

A valve actuator 15 is coupled to the sliding gate 14 for shifting the latter between its open and closed positions. As illustrated, the actuator is a double-acting hydraulic ram. The actuator is coupled through a pair of ducts 16 to a reversible hydraulic control valve 17. In turn, the hydraulic valve 17 is connected via ducts 18 and 19 to a source of hydraulic pressure and to a reservoir. The hydraulic valve can be either servo-controlled or solenoid operated.

The achievement of a constant rate of flow of molten metal from the ladle is attainable by metering the discharge orifice 11 by the gate 14. The exact position or registry of the gate 14 with the orifice 11 in this case is controlled as a function of the instantaneous weight of the ladle and its contents. To this end, a load cell 20 is employed which is interposed between a ladle rest 21 and a ladle carriage 22.

A signal representing the combined weight 1 of the ladle and its contents is generated by the load cell 20 and is fed to a differentiating circuit 23 of a valve control unit 24. The differentiating circuit 23 produces an output $1/t$, the level of which represents the decrease with time in the load on the cell 20 as the molten metal is allowed to flow from the ladle 10. The output $1/t$ thus represents the actual flow rate at which metal is teemed from the ladle 10. The output $1/t$ is fed as one input 26 to a comparator or difference amplifier 27. The amplifier 27 receives at its second input 28 a reference signal obtained from a presettable signal generator 30. The reference signal is set to correspond to a desired flow rate. When the actual flow rate departs from the desired value, an error signal appears at the output of the amplifier 27. The error signal 31 is suitably amplified in an amplifier 32 and is fed to the servo or solenoid controlling the hydraulic valve 17.

The sign of the error signal, i.e. whether it is positive or negative, will depend upon whether the actual flow rate is larger or smaller than the preset desired value. Depending upon the sign and the magnitude of the error signal, the valve 17 will operate to move the actuator ram and thus the gate 14 by a distance and in such a direction as will bring the actual flow rate to the desired value. In practice, to attain a constant flow rate, the sliding gate 14 will be opened progressively as metal runs out of the ladle 10 and the pressure head at the orifice 11 falls. Clearly, were the gate 14 not so opened, the flow rate would fall as the surface level of metal in the ladle 10 drops.

It will be understood that the load cell 20 operates in a compression mode in the FIG. 1 illustration. An alternative arrangement is sketched in FIG. 2. Here, the ladle 10' is suspended from an overhead crane, the load cell 20' being incorporated in the suspension 33.

The equipment shown in FIG. 1 is particularly suitable for use when charging a series of ingot moulds. The equipment is also useful for charging the tundish of a continuous casting plant. However, when used in that case, greater sensitivity can be attained by means of a simple modification. Instead of sensing the weight change of the charging ladle, the load cell is then used to monitor the weight of the tundish and its contents. The output of the load cell is used to control the rate of discharge from ladle to tundish so as to maintain the overall weight of the tundish within desired limits. In this way, a substantially constant liquid level in the tundish can be obtained, and the rate of flow from the tundish to the mould can also be controlled.

It will be appreciated that the operation of flow rate control can be employed to obtain constancy of flow. Flow rate control can, alternatively, be used in a profile teeming operation, especially where ingots are to be teemed in chill moulds. In such a teeming operation, it may be desired to start teeming at a low rate, to avoid splashing, thereafter to teem at a higher, substantially constant rate and finally to teem at a low rate towards the end of the pour. Profile teeming can be controlled by manually presetting the reference signal generator. Alternatively, this generator could be pre-set mechanically be means of a suitable programmer.

I claim:

1. Apparatus for admitting molten metal into a receiver vessel, said apparatus comprising:

a charging vessel which has a discharge orifice and includes a sliding gate valve for controlling flow of molten metal through said orifice to said receiver vessel;

means for actuating said valve to achieve a controlled flow rate therethrough and being reliant solely on a monitoring of the overall weight of one of said vessels, said means including:

a load sensor on said one of said vessels, the weight of which is monitored;

a differentiating circuit connected with said sensor for differentiating a load sensor output signal with respect to time;

a presettable reference signal generator;

a difference amplifier having inputs connected both to said differentiating circuit and to said reference signal generator to receive output signals from each;

said difference amplifier being operative to derive an error output signal from the input signals thereto from said differentiating circuit and said reference signal generator; and a valve actuator connected to said difference amplifier to which said valve actuator said error output signal is fed for controlling the setting of said valve.

2. Apparatus according to claim 1, wherein said charging vessel is a bottom pour ladle.

3. Apparatus according to claim 1, wherein said charging vessel is a tundish.

4. Apparatus according to claim 1, wherein said load sensor is adapted to monitor the overall weight of said charging vessel.

5. Apparatus according to claim 1, wherein said charging vessel is a bottom-pour ladle, equipped with a sliding gate valve, said receiver vessel is a tundish of a continuous casting plant, and said load sensor is adapted to monitor the overall weight of said tundish, said means for actuating said sliding gate valve being adapted to control said valve to keep the overall weight of said tundish constant, thereby maintaining a substantially constant level of melt in said tundish.

6. Apparatus according to claim 1, wherein said load sensor comprises at least on load cell.

7. Apparatus according to claim 6, wherein said load cell is of the strain-gauge type.

8. Apparatus according to claim 1, wherein said valve actuating means comprises a double-acting hydraulic ram and an electrically-operated flow control valve therefor, said error signal being applied to said flow-control valve.

9. Apparatus according to claim 1, wherein said valve actuating means comprises an electric motor to which said error signal is applied.

10. A method of teeming molten metal into a receiver vessel at a controlled rate employing apparatus as claimed in claim 1.

* * * * *